US010100485B1

(12) United States Patent
Ash

(10) Patent No.: US 10,100,485 B1
(45) Date of Patent: Oct. 16, 2018

(54) RETAINING WALL COUNTERFORT AND RETAINING WALL SYSTEM

(71) Applicant: NORTHERN STRESSWALL CANADA LTD., Vancouver (CA)

(72) Inventor: David Ash, Vancouver (CA)

(73) Assignee: Northern Stresswell Canada Ltd., Vancouver (CA)

( * ) Notice: Subject to any disclaimer, the term of this patent is extended or adjusted under 35 U.S.C. 154(b) by 4 days.

(21) Appl. No.: 15/719,025

(22) Filed: Sep. 28, 2017

(51) Int. Cl.
*E02D 29/02* (2006.01)

(52) U.S. Cl.
CPC ..... *E02D 29/0233* (2013.01); *E02D 29/0266* (2013.01); *E02D 2300/002* (2013.01); *E02D 2600/20* (2013.01); *E02D 2600/30* (2013.01)

(58) Field of Classification Search
CPC ..... E02D 17/00; E02D 29/02; E02D 29/0216; E02D 29/0225; E02D 29/0233; E02D 29/0241; E02D 29/0266; E02D 29/063; E02D 29/073; E02D 29/077; E02D 29/12; E21D 1/06; E21D 9/08; E21D 9/10; E21D 11/385
USPC ..... 405/262, 286, 285, 273, 284, 272
See application file for complete search history.

(56) References Cited

U.S. PATENT DOCUMENTS 554,680 A * 2/1896 Haetges ..... E02B 17/00 405/203
1,231,426 A * 6/1917 Ravier ..... E02D 29/0241 405/262
1,701,841 A * 2/1929 Evers ..... E04C 3/20 405/273
1,871,439 A * 8/1932 Alexander ..... E02D 29/0216 405/273
2,123,016 A * 7/1938 McDaniel ..... E02D 29/0216 405/273
2,193,425 A * 3/1940 Lake ..... A01G 9/28 47/33
2,197,960 A * 4/1940 Alexander ..... E02D 29/0216 405/273
3,466,874 A * 9/1969 Holl ..... E02D 17/04 248/228.4
3,686,873 A * 8/1972 Vidal ..... E02D 29/0241 405/262
4,050,254 A * 9/1977 Meheen ..... E02D 29/0266 405/285
4,655,646 A * 4/1987 Babcock ..... E02D 29/0266 405/262
4,668,129 A * 5/1987 Babcock ..... E02D 29/0266 405/284
4,671,706 A * 6/1987 Giardini ..... E02D 29/025 405/286
4,884,921 A * 12/1989 Smith ..... E02D 29/0241 405/286

(Continued)

*Primary Examiner* — Benjamin F Fiorello
*Assistant Examiner* — Edwin J Toledo-Duran
(74) *Attorney, Agent, or Firm* — Borden Ladner Gervais LLP; Geoffrey deKleine

(57) ABSTRACT

A retaining wall counterfort includes a body having an elongate base and a rigid head extending from the base for engagement with a further retaining wall component. The base includes a front surface, which may abut a further retaining wall component, and a rear surface. A connecting loop is embedded in the base and extends away from the base, past the rear surface of the base, for engaging a head of a second counterfort.

16 Claims, 6 Drawing Sheets

(56) References Cited

U.S. PATENT DOCUMENTS

| | | | | | |
|---|---|---|---|---|---|
| 4,929,125 | A * | 5/1990 | Hilfiker | E02D 29/025 | 405/262 |
| 5,456,554 | A * | 10/1995 | Barrett | E02D 29/0225 | 405/262 |
| 5,624,211 | A * | 4/1997 | Anderson | E02D 29/02 | 405/262 |
| 6,079,908 | A * | 6/2000 | Anderson | E02D 29/02 | 405/262 |
| 6,113,316 | A * | 9/2000 | Ash | E02D 29/025 | 405/262 |
| 6,312,197 | B1 * | 11/2001 | Woolford | B28B 7/0097 | 405/284 |
| 6,427,417 | B1 * | 8/2002 | Sagy | E02D 5/74 | 405/262 |
| 6,692,195 | B2 * | 2/2004 | Jansson | E01F 8/022 | 405/286 |
| 7,908,799 | B2 * | 3/2011 | Mugge | E04C 1/395 | 405/284 |
| 8,256,182 | B2 * | 9/2012 | Wolter | E04C 1/395 | 52/561 |
| D730,543 | S * | 5/2015 | Burnquist | D25/113 | |
| 9,103,089 | B2 * | 8/2015 | Ogorchock | E02D 29/0266 | |
| 9,745,743 | B2 * | 8/2017 | Wolter | E04C 1/395 | |
| 2015/0071715 | A1 * | 3/2015 | Hammer | E02D 29/0233 | 405/286 |

* cited by examiner

RETAINING WALL COUNTERFORT AND RETAINING WALL SYSTEM

TECHNICAL FIELD

The present disclosure relates to modular soil retention systems for use in retaining walls.

BACKGROUND

Retaining walls are useful for stabilizing soil and inhibiting the soil from sliding or eroding away. Retaining wall systems generally resist the pressure from the soil that is held back. Many different retaining wall systems are available for building relatively tall retaining walls. Such systems include, for example, gravity retaining walls, reinforced concrete and reinforced soil retaining walls, soil nailing, and anchored earth walls.

Retaining wall systems that provide a generally smooth faced retaining wall structure, i.e., without the use of protruding vertical columns are desirable. One common type of gravity retaining wall system utilizes large, precast concrete blocks or units that are stacked to form a wall. The weight of the blocks of the wall is utilized to stabilize the structure and retain the soil. Such walls require extensive amounts of concrete and require large powered equipment for transportation and placement of the large and heavy concrete blocks.

Mechanically stabilized earth or reinforced soil walls are also utilized. In most examples, very large facing panels of over 500 kg in weight are utilized with extensive steel soil reinforcement. Because of the weight of the facing panels and the steel reinforcement, large powered equipment for transportation and placement of the facing panels and reinforcement is required.

As a result of the size, weight, and the required specialized equipment for transportation and placing of the components, these retaining wall systems are difficult and expensive to install.

Improvements in retaining wall systems are desirable.

SUMMARY

According to an aspect of the present invention, there is provided a retaining wall counterfort including a body having an elongate base and a rigid head extending from the base for engagement with a further retaining wall component. The base includes a front surface, which may abut a further retaining wall component, and a rear surface. A connecting loop is embedded in the base and extends away from the base, past the rear surface of the base, for engaging a head of a second counterfort.

According to another aspect, a retaining wall system is provided. The system includes a wall panel member having a wall panel connection loop extending from a rear of the wall panel, a first retaining wall counterfort, and a second retaining wall counterfort. The first retaining wall counterfort includes a first body including an elongate first base and a first rigid head extending from the first base. The wall panel connecting loop of the wall panel member engages with the first rigid head. The first base includes a first front surface and a first rear surface. A first connecting loop is embedded in the first base and extends away from the first base, past the first rear surface of the first base. The second retaining wall counterfort includes a second body including an elongate second base and a second rigid head extending from the second base. The first connecting loop of the first retaining wall counterfort engages with the second rigid head. The second base includes a second front surface and a second rear surface.

BRIEF DESCRIPTION OF THE DRAWINGS

Embodiments of the present invention will be described, by way of example, with reference to the drawings and to the following description, in which.

DETAILED DESCRIPTION

Figure 1:
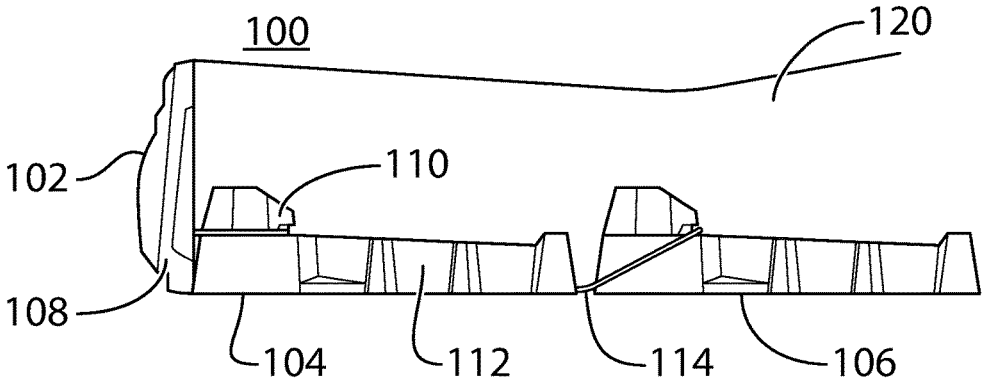
FIG. 1 is a perspective view from within a soil mass, of an assembled retaining wall system in accordance with an embodiment of the present invention.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

The disclosure generally relates to a retaining wall counterfort including a body having an elongate base and a rigid head extending from the base for engagement with a further retaining wall component. The base includes a front surface, which may abut a further retaining wall component, and a rear surface. A connecting loop is embedded in the base and extends away from the base, past the rear surface of the base, for engaging a head of a second counterfort.

An assembled retaining wall system according to one example is illustrated in FIG. 1 and is indicated generally by the numeral 100. The assembled components of the retaining wall system 100 include a wall panel 102, a first counterfort 104 coupled to the wall panel 102, and a second counterfort 106 coupled to the first counterfort. A plurality of such retaining wall systems 100 may be utilized for retaining compacted backfill material 120.

The retaining wall system 100 illustrated is a non-extendible soil reinforcement in that the reinforcement does not stretch prior to failure, as in plastic and fabric types of geo-grid soil reinforcement. Such non-extendible mechanically stabilized earth retaining walls may be constructed to a height that is dependent on the length of the reinforcement in the soil. Thus, for greater height retaining walls, a greater length of reinforcement is utilized. Rather than utilizing extremely large counterforts that may require specialized forms and are more difficult to transport and locate, the counterforts according to an aspect of the present application are generally small and the overall length of each retaining wall system 100 within the soil is customizable by coupling multiple counterforts together in sequence. The use of such counterforts facilitates transportation to a site and location of the counterforts within a retaining wall, while providing reinforcement sufficient for retaining walls of great height.

The wall panel 102 includes the wall panel member 108 and the connecting loop 110. The wall panel member 108 is a precast concrete that is cast with the wall panel connecting loop 110 partially embedded therein such that the wall panel connecting loop 110 is integral with the precast concrete wall panel member 108. The wall panel connecting loop 110 may be any suitable material for joining the wall panel with the first counterfort 104. For example, the wall panel connecting loop 110 may be made of a cable that is incorporated into the wall panel member 108 or may be made of a rigid material, such as a shaped steel rod embedded into the wall panel member 108.

The first counterfort 104 includes a body 112 and the connecting loop 114. The body 112 is a precast concrete that is cast with the connecting loop 114 embedded therein such that the connecting loop 114 is integral with the precast concrete body 112. The first counterfort 104 may be cast utilizing any suitable mold, including a recycled plastic mold. As with the wall panel connecting loop 110, the connecting loop 114 of the first counterfort 104 may be any suitable material for joining the first counterfort 104 to a second counterfort. For example, the connecting loop 114 may be made of a cable that is incorporated into the body 112 of the first counterfort 104 or may be made of a rigid material, such as a shaped metal bar or steel rod embedded into the body 112.

Figure 2:
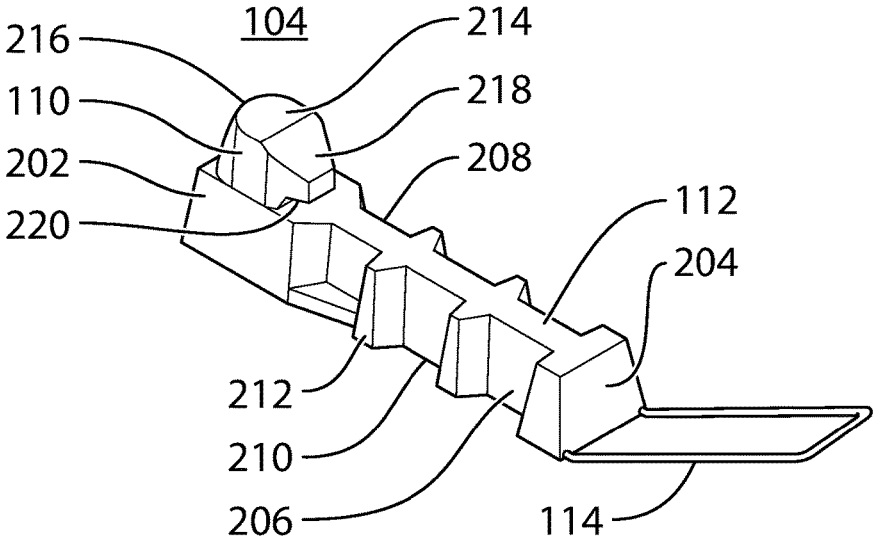
FIG. 2 is a perspective view of a counterfort of a retaining wall system in accordance with an embodiment of the present invention.

Referring now to FIG. 2, a perspective view of the first counterfort 104 is shown. The body 112 of the first counterfort 104 includes an elongate base 206 that extends longitudinally from a front surface 202 to a rear surface 204. The front surface 202 in the present example is planar, for abutting a further retaining wall component, such as the wall panel 102. The rear surface 204 in the present example is also planar. The elongate base 206 is a polyhedron and includes a generally flat top 208 and a generally flat bottom 210 to abut a surface of, for example, compacted backfill and to facilitate alignment of the body 112 within a retaining wall.

The body 112 also includes projections 212 that extend laterally from each side of the base 206. The projections 212 extend the full height of the base 206 and from both sides of the base 206 such that a right side of the body 112 mirrors the left side of the body 112. The projections 212 are also polyhedron shaped and extend outwardly from the base 206 to provide additional surface area for engaging with the backfill or soil.

A rigid head 214 extends from the top 208 of the base 206, near the front surface 204. Thus, the head 214 extends from the top 208, near one end of the base 206. The head 214 may be any suitable shape for engaging with a connecting loop of a wall panel, as illustrated in FIG. 1, or with a connecting loop of another counterfort that is adjacent to or abuts the front surface 202 of the base 206. In the present example, the head 214 is generally curved at a front end 216 thereof and includes a lip 218 at a rear end. The lip 218 protrudes outwardly toward the rear surface 204 of the base 206 to provide a groove 220 in the head 214 for receiving an end of a connecting loop therein and trapping the connecting loop between the top 208 of the base 206 and the lip 218 of the head 214.

As indicated above, the body 112 is a precast concrete that is cast with the connecting loop 114 embedded therein such that the connecting loop 114 is integral with the precast concrete body 112. The body 112 may include rebar or other reinforcement within the concrete. The connecting loop 114 may be any suitable material. In the present example, the connecting loop 114 is a shaped metal bar or steel rod and is embedded into the body 112 and extends from the body 112 of the counterfort 104. As indicated above, however the connecting loop may be made of any suitable material. The metal utilized for the connecting loop may be a similar steel to that utilized to reinforce the concrete to reduce the chance of corrosion that results from the use of dissimilar metals.

The connecting loop 114 extends from both sides of the base 206, near the rear surface 204, and away from the base 206 for engaging a head of a counterfort located behind the rear surface 204. The connecting loop 114 is therefore sized and shaped to form a loop around the head of the next counterfort.

The second counterfort 106, as illustrated in FIG. 1, may be similar to the first counterfort 104. Optionally, the second counterfort 106 may be without a connecting loop 114, for example, when the second counterfort 106 is the final counterfort in a series of counterforts, as described herein below.

Figure 3:
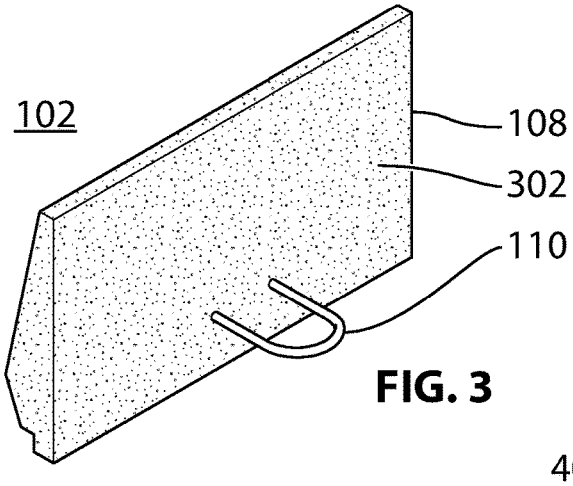
FIG. 3 is a perspective view of a wall panel of a retaining wall system in accordance with an embodiment of the present invention.

A perspective view of a wall panel 102 of a retaining wall system is shown in FIG. 3. The wall panel 102 includes a wall panel member 108 and a wall panel connecting loop 110. The wall panel member 108 is generally rectangular in shape and has a thickness and strength that is sufficient to transmit the retained soil load from the wall panel member 108, through the moment connection between the wall panel connecting loop 110 and the front surface 202 of the first counterfort 114, against which the wall panel member 108 bears. The wall panel member 108 may be formed of a precast concrete and is cast with the wall panel connecting loop 110 embedded within the wall panel member 108. The wall panel connecting loop 110 extends generally from a center of a rear side 302 of the wall panel member 108. A cross-section of the wall panel member 108 may vary depending on design or architecture of the retaining wall system.

Figure 4:
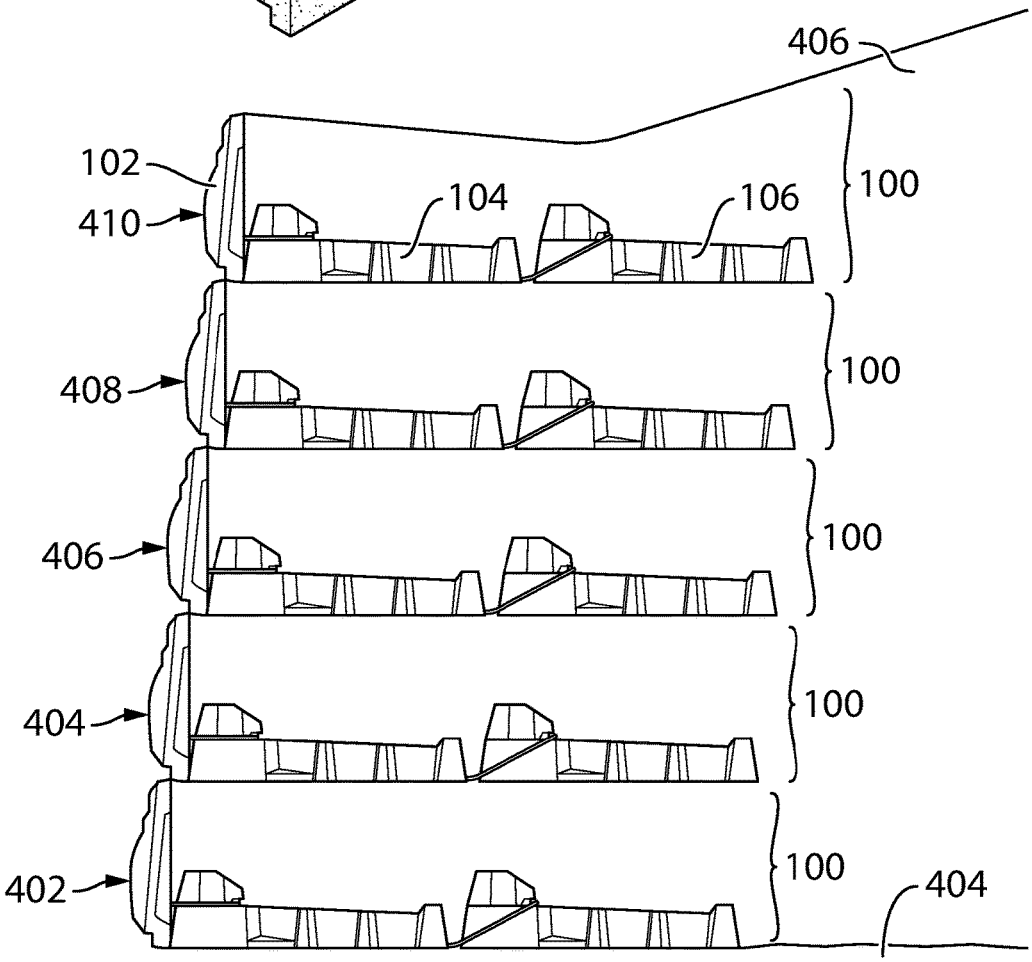
FIG. 4 is a sectional view of an assembled five-tier retaining wall in accordance with an example.

An example of an assembled five-tier retaining wall including retaining wall systems 100 that include the counterfort 104 and the wall panel 102, is illustrated in FIG. 4. The first tier 402 of retaining wall systems 100 are erected on a base excavation 404. The first tier 402 of retaining wall systems 100 includes a plurality of the retaining wall systems 100 with the wall panels 102 of each retaining wall system adjacent to a wall panel 102 of at least one other retaining wall system 100. Each retaining wall system 100 includes the wall panel 102, at least one first counterfort 104, and a second counterfort 106. The second counterfort 106 may, optionally, be similar to the first counterfort 104 but without a connecting loop embedded into the body 112 of the counterfort 104 and extending from near the rear surface.

Backfill 406 is then placed to the level of the base of the next higher tier. The backfill 406 utilized may be selected to resist pullout of the first counterfort 104. The second tier 408 of retaining wall systems 100 are then erected on the backfill and additional backfill is placed to the level of the base of the next higher tier. The third tier 410 of retaining wall systems 100 are then erected on the backfill and additional backfill is placed to the level of the base of the next higher tier. The fourth tier 412 of retaining wall systems 100 are then erected on the backfill and additional backfill is placed to the level of the base of the next higher tier. The fifth tier 414 of retaining wall systems 100 are then erected on the backfill and the backfill is placed and compacted to the level of the final grade. When the retaining wall is completed and backfill compacted, very little differential movement between counterforts within each retaining wall system occurs. The compacted backfill restrains differential vertical movement with each retaining wall system.

Figure 5:
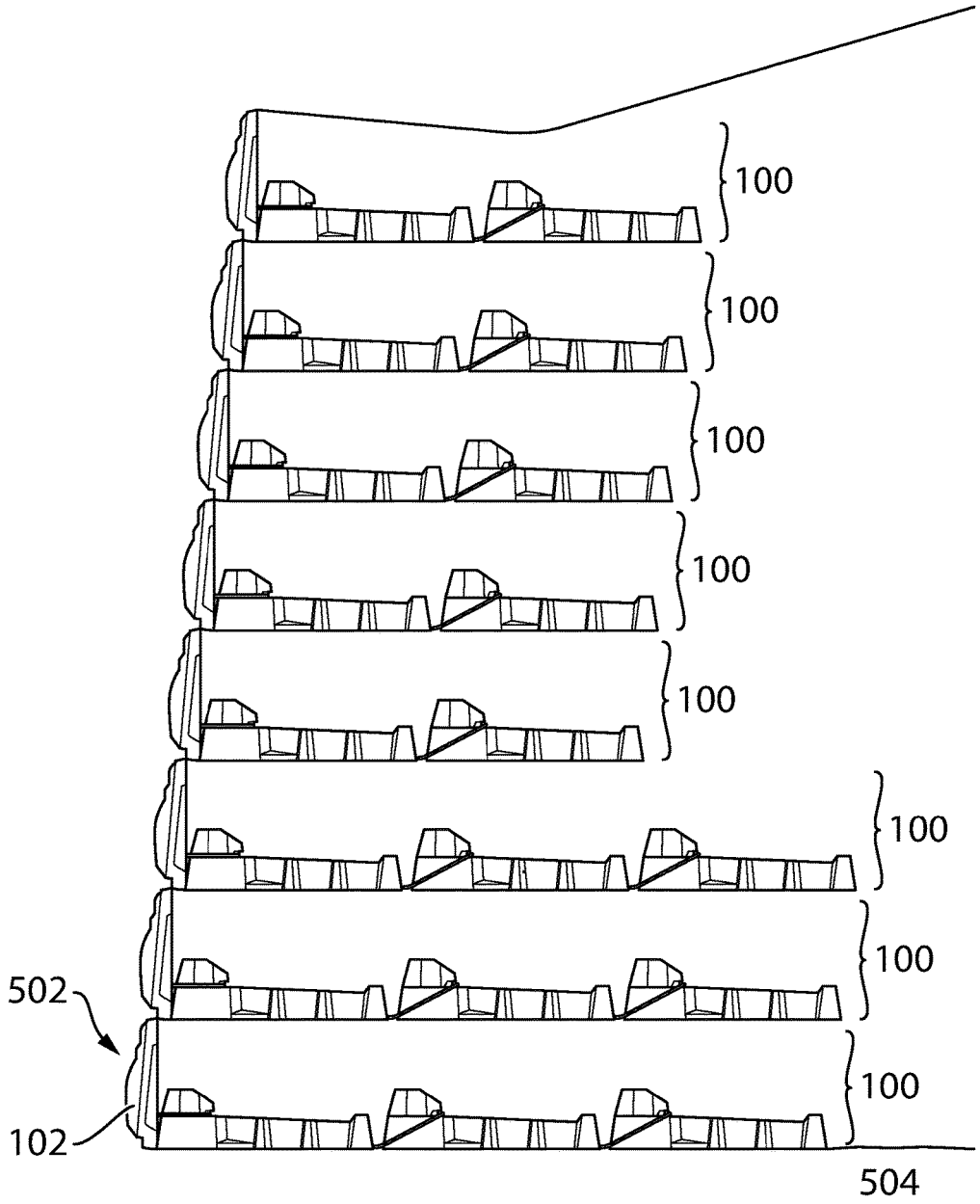
FIG. 5 is a section view of an assembled multi-tier retaining wall in accordance with another example.

An example of an assembled multi-tier retaining wall including retaining wall systems 100 that include the counterfort 104 and the wall panel 102, is illustrated in FIG. 5. In this particular example, the assembled retaining wall includes 7 tiers. The lowest of the three tiers, however, each include three counterforts. The first two counterforts are similar to the first counterfort 104 described above with reference to FIG. 2 and with reference to FIG. 5. As in the example of FIG. 4, the final counterfort in each tier may be without a counterfort connecting loop embedded into the body 112 of the counterfort 104 and extending from near the rear surface.

As in the example shown in FIG. 4, the first tier 502 of retaining wall systems 100 are erected on a base excavation 504. The first tier 502 of retaining wall systems 100 includes a plurality of the retaining wall systems 100 with the wall panels 102 of each retaining wall system 100 adjacent to a wall panel 102 of at least one other retaining wall system 100. Backfill is then placed to the level of the base of the next higher tier. The next tier of retaining wall systems 100 are then erected on the backfill and additional backfill is placed to the level of the base of the next higher tier. The process continues until all retaining wall systems are erected with backfill placed and compacted to the level of the final grade.

The lower tiers of retaining wall systems 100 in a retaining wall may include more counterforts. Utilizing the counterfort 104 as shown in FIG. 2, several counterforts may be linked together in sequence facilitating use for retaining walls of greater height.

Figure 6:
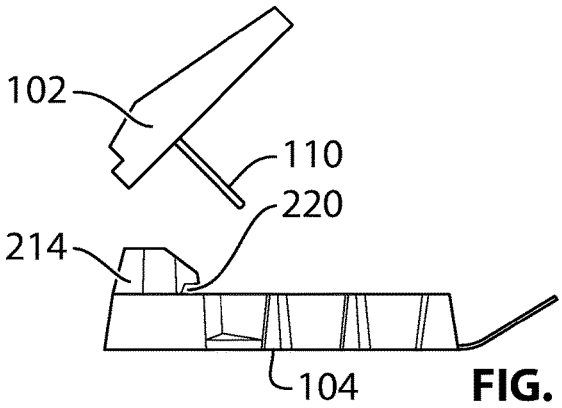
FIG. 6 through 9 illustrate assembly of a wall panel and counterfort in accordance with an embodiment of the present.
Figure 7:
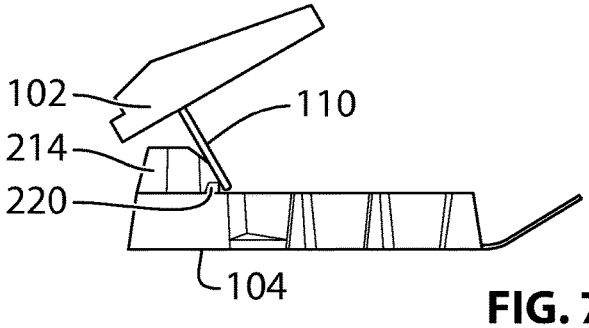
Figure 8:
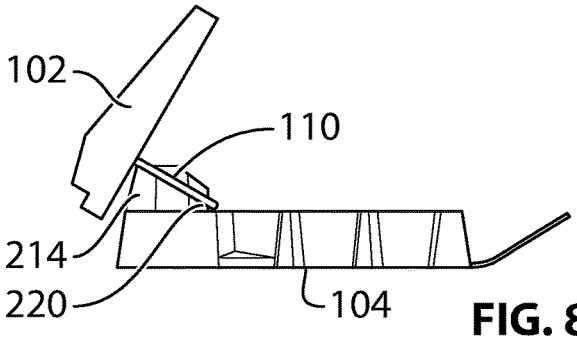

FIG. 6 through FIG. 9 illustrate assembly of a wall panel and counterfort in assembling a retaining wall system, such as the retaining wall systems 100 of FIG. 4. The wall panel 102 is mechanically coupled utilizing the wall panel connecting loop 110, to the first counterfort 104. The wall panel connecting loop 110 is disposed in the groove 220 of the head 214 of the first counterfort 104. FIG. 6 illustrates the wall panel 102 and the first counterfort 104 prior to assembly. The first counterfort 104 is located to line and grade and the wall panel 102 is located above and at an angle to the first counterfort 104 and to the desired end position, in order to hook the wall panel connecting loop 110 over the head 214 of the first counterfort 104. The wall panel connecting loop 110 is hooked over the head 214 of the first counterfort 104, as illustrated in FIG. 7 and firmly seated in the groove 220. The wall panel 102 is rotated relative to the first counterfort 104 as illustrated in FIG. 8, to the vertical position shown in FIG. 9.

Figure 9:
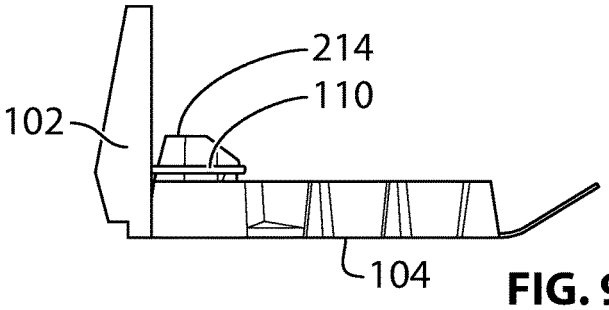
Figure 10:
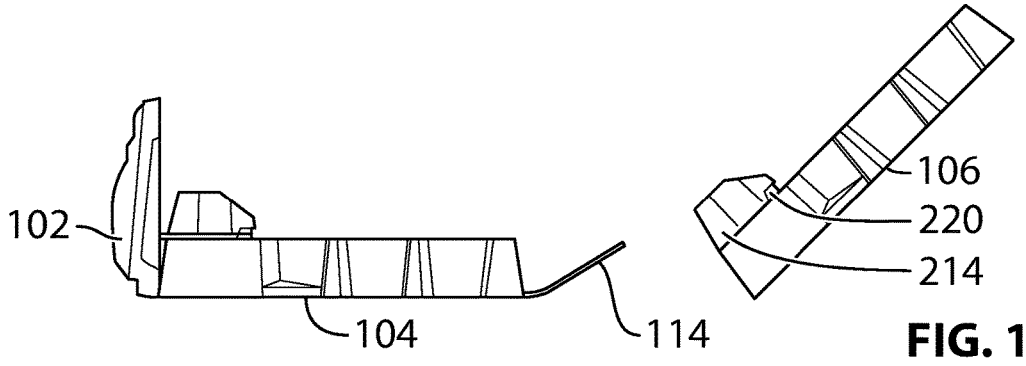
FIG. 10 through 13 invention illustrate assembly of a pair of counterforts in accordance with an embodiment of the present invention.
Figure 11:
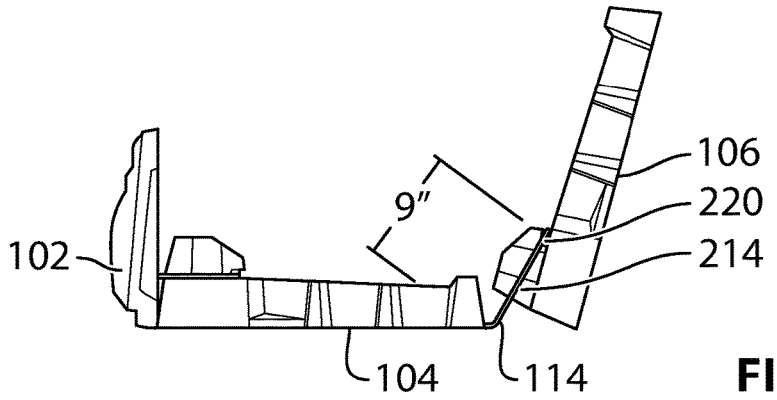
Figure 12:
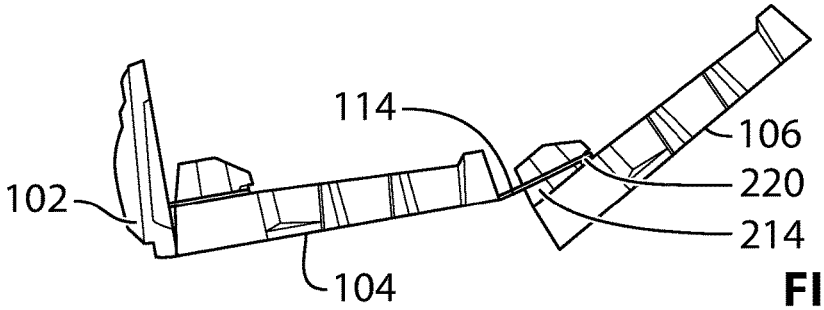
Figure 13:
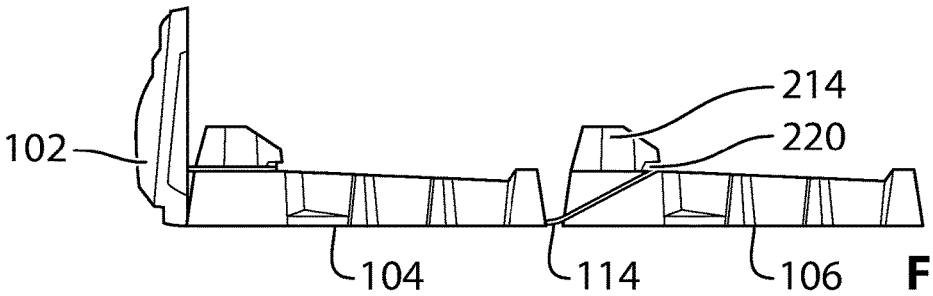

FIG. 10 through FIG. 13 illustrate assembly of a pair of counterforts, such as the counterforts illustrated in FIG. 4. The first counterfort 104 is mechanically coupled, utilizing the connecting loop 114, to the second counterfort 106. The connecting loop 114 is disposed in a groove 220 of the head 214 of the second counterfort 106. FIG. 9 illustrates the first counterfort 104 and the second counterfort 106 prior to assembly, the first counterfort 104 and wall panel 102, already having been assembled. The second counterfort 106 is located in line with the first counterfort and is angled relative to the first counterfort 104 and relative to the desired end position, as shown in FIG. 10. The second counterfort is located, while at an angle, such that the connecting loop 114 of the first counterfort 104 is hooked over the head of the second counterfort 106. The connecting loop 114 of the first counterfort 104 is firmly seated in the groove in the head of the second counterfort 106. The second counterfort 106 is then rotated, about a front edge on grade, relative to the first counterfort 104. As the rotation of the second counterfort 106 is carried out, the first counterfort 104 and the wall panel 102 are rotated together, relative to the surface on which the first counterfort 104 is located, as illustrated in FIG. 11. The rotation of the second counterfort 106 continues until the bottom of the base lies on grade and the first counterfort 104 is returned to or continues to lie flat on grade, as illustrated in FIG. 12. In the positions illustrated in FIG. 12, the connecting loop 114 of the first counterfort 104 is firmly seated in the groove in the head of the second counterfort 106.

For retaining wall systems 100 that include more than two counterforts, each counterfort 104, with the exception of the final counterfort in the sequence, includes a connecting loop 114, as described with reference to FIG. 2. The additional counterforts are added in sequence from front of the retaining wall toward a back or end of the sequence. Each counterfort 104 is added in a similar manner to that described above with reference to FIG. 10 through FIG. 13.

Figure 14:
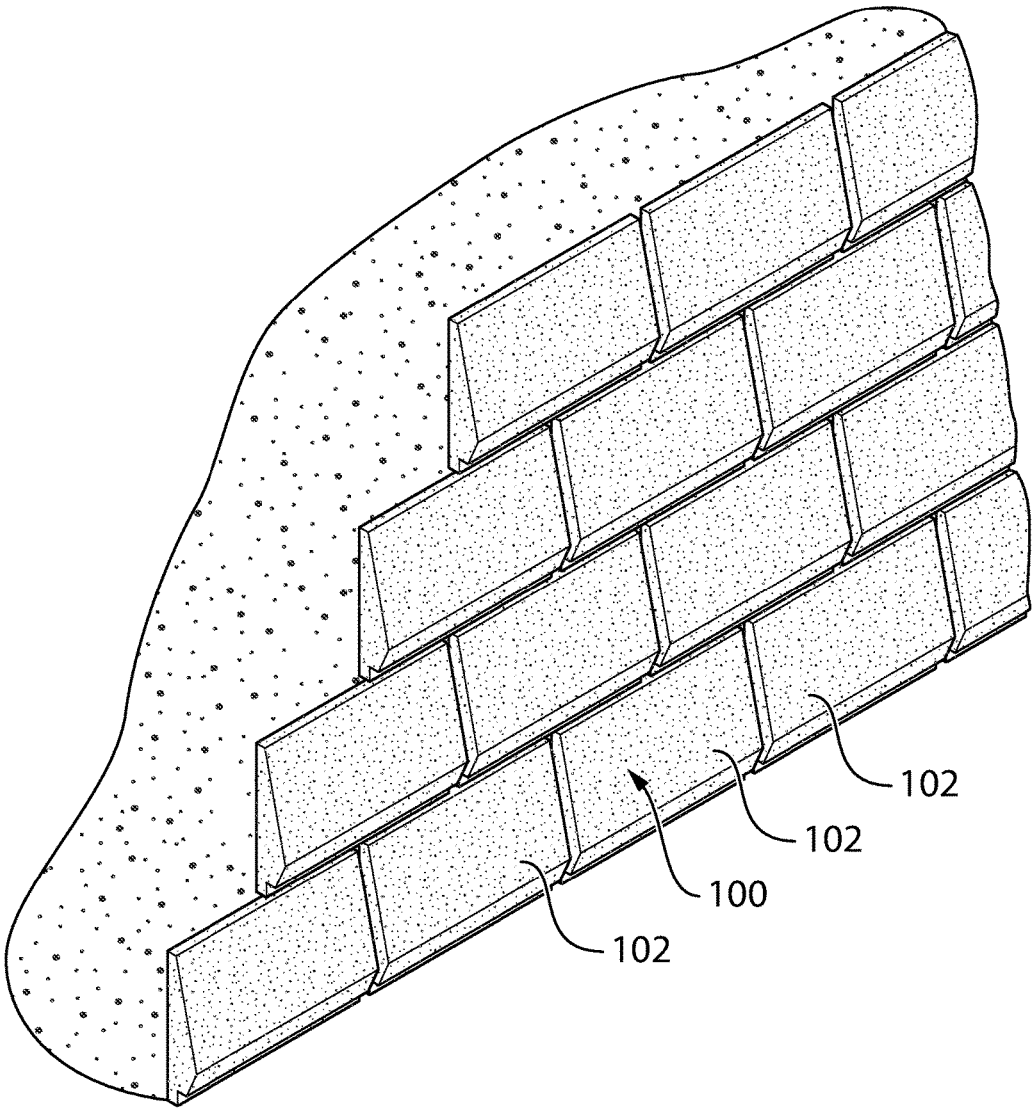
FIG. 14 is a perspective view of an implementation of a multi-tier retaining wall in accordance with an embodiment of the present invention.

An implementation of a multi-tier retaining wall is illustrated in FIG. 14. The multi-tier retaining wall includes multiple tiers of retaining wall systems 100 that together provide a front wall face. Each tier of the retaining wall systems is offset laterally from the tier above and from the tier below such that the wall panels 102 are each offset by about half the length of each wall panel 102.

Advantageously, the retaining wall system may include several counterforts, each of which is small enough to be handled and placed by hand. Several counterforts may be coupled together to provide an overall length of the counterforts that is sufficient for reinforcement for a retaining wall of several tiers. Thus, the number of counterforts in sequence is customizable depending on the application. The use of such counterforts facilitates transportation to a site and location of the counterforts within a retaining wall, while providing reinforcement sufficient for retaining walls of great height, even in seismically active zones. Further, the use of multiple counterforts rather than a single counterfort, reduces the bending moments within the concrete and tension in each concrete element.

The overall volume of concrete utilized for a retaining wall is significantly reduced by comparison to large block walls. Retaining wall systems of one tier do not stack directly on retaining wall systems of the tier below. Instead, the retaining wall systems are seated independently in the backfill. As a result, even for retaining walls of great height, there is very little crushing force on each of the concrete elements of the retaining wall, which could lead to damage.

The above-described embodiments of the invention are intended to be examples only. Alterations, modifications, and variations may be effected to the particular embodiments by those skilled in the art. Thus, the scope of the claims should not be limited by the embodiments set forth in the examples, but should be given the broadest interpretation consistent with the description as a whole.

What is claimed is:

1. A retaining wall counterfort comprising:

A cast concrete body including an elongate base and a rigid head extending from the base and configured to engage a further retaining wall component, the base including a front surface and a rear surface; and A connecting loop cast into the base of the cast concrete body, the connecting loop extending away from the base in which the connecting loop is embedded, past the rear surface of the base, and configured to extend around a head of a second counterfort to engage with the second counterfort, Wherein the head of the cast concrete body includes a groove therein configured for engagement of a further connecting loop of the further retaining wall component, in the groove of the head of the cast concrete body.

2. The retaining wall counterfort according to claim 1, wherein the connecting loop comprises a rigid material that extends along a part of the base and out of the base.

3. The retaining wall counterfort according to claim 1, wherein the connecting loop comprises a metal bar.

4. The retaining wall counterfort according to claim 1, wherein the connecting loop extends from the base, near the rear surface thereof.

5. The retaining wall counterfort according to claim 1, wherein the body includes projections extending laterally from the base, for engagement soil.

6. A retaining wall system comprising:

a wall panel member having a wall panel connection loop extending from a rear of the wall panel;

a first retaining wall counterfort comprising:

a first cast concrete body including an elongate first base and a first rigid head extending from the first base, the wall panel connecting loop of the wall panel member in engagement with the first rigid head, the first base including a first front surface and a first rear surface; and a first connecting loop cast into the first base of the first cast concrete body, the first connecting loop extending away from the first base in which the first connecting loop is embedded, past the first rear surface of the first base;

a second retaining wall counterfort comprising:

a second cast concrete body including an elongate second base and a second rigid head extending from the second base, the first connecting loop of the first retaining wall counterfort extending around the second rigid head to engage with the second cast concrete body, the second base including a second front surface and a second rear surface.

7. The retaining wall system according to claim 6, wherein the second retaining wall counterfort comprises a second connecting loop cast into the second base of the second cast concrete body, the second connecting loop extending away from the second base in which the second connecting loop is embedded, past the second rear surface of the second base.

8. The retaining wall system according to claim 7, comprising a plurality of retaining wall counterforts, including the first retaining wall counterfort and the second retaining wall counterfort, coupled together in series.

9. The retaining wall system according to claim 6, wherein the first connecting loop comprises a rigid material that extends along a part of the base and out of the base.

10. The retaining wall system according to claim 6, wherein the first connecting loop comprises a metal bar.

11. The retaining wall system according to claim 6, wherein the first connecting loop extends from the first base, near the first rear surface.

12. The retaining wall system according to claim 6, wherein the first head includes a groove therein for engagement with the wall panel connecting loop.

13. The retaining wall system according to claim 6, wherein the second rigid head of the second retaining wall counterfort includes a groove therein for engagement with the first connecting loop of the first retaining wall counterfort.

14. The retaining wall system according to claim 6, wherein the first body includes projections extending laterally from the first base, for engagement with the soil.

15. A retaining wall comprising a plurality of the retaining wall systems of claim 6, arranged in a first row such that the wall panel member of each retaining wall system abuts a wall panel member of an adjacent retaining wall system.

16. The retaining wall according to claim 15, comprising a plurality of rows of the retaining wall systems, including the first row, arranged in tiers.

* * * * *